US007833011B2

(12) United States Patent
Jönsson et al.

(10) Patent No.: US 7,833,011 B2
(45) Date of Patent: Nov. 16, 2010

(54) METHOD AND DEVICE FOR IGNITING AND MONITORING A BURNER

(75) Inventors: Bo Jönsson, Västerås (SE); Kari Korhonen, Hallstahammar (SE); Pauli Mäenpää, Arboga (SE); Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 15 days.

(21) Appl. No.: 11/665,829

(22) PCT Filed: Oct. 11, 2005

(86) PCT No.: PCT/SE2005/001504

§ 371 (c)(1),
(2), (4) Date: Jun. 12, 2007

(87) PCT Pub. No.: WO2006/043870

PCT Pub. Date: Apr. 27, 2006

(65) Prior Publication Data

US 2007/0298359 A1 Dec. 27, 2007

(30) Foreign Application Priority Data

Oct. 22, 2004 (SE) ..... 0402559

(51) Int. Cl.
*F23N 5/08* (2006.01)

(52) U.S. Cl. ..... 431/79; 431/13; 431/284; 431/285; 431/353; 60/39.826; 60/39.827; 250/227.11; 250/554

(58) Field of Classification Search ..... 431/79, 431/8, 263, 266, 78, 349, 264, 187, 347, 431/10, 12, 15, 284, 285, 353, 59, 25; 250/554, 250/227.11, 372, 373; 340/578; 60/39.826, 60/39.827; 65/134.4, 134.5; 219/121.52, 219/121.5

See application file for complete search history.

(56) References Cited

U.S. PATENT DOCUMENTS 4,311,452 A * 1/1982 Begin ..... 431/352
4,541,798 A 9/1985 Miller et al.

(Continued)

FOREIGN PATENT DOCUMENTS

JP 3160215 7/1991

(Continued)

*Primary Examiner*—Steven B McAllister
*Assistant Examiner*—Avinash Savani
(74) *Attorney, Agent, or Firm*—Young & Thompson

(57) ABSTRACT

A method of igniting and monitoring a high speed burner with which a fuel/oxygen-mixture exits at high velocity from a burner head, wherein the length of the flame is governed by the exit velocity of the mixture. The invention is characterized by placing an electrically conductive pipe in and concentrical with the burner channel for the fuel mixture, by causing a first end of the pipe to terminate close to the fuel mixture outlet of the burner head, by electrically isolating the pipe and by causing the detection of light of the group ultraviolet light, visible light and/or infrared light to be detected at the other end of the pipe, and by causing a spark to be generated between the first end of the pipe and the surrounding burner head by application of a voltage, in igniting the burner. A burner is also disclosed.

19 Claims, 1 Drawing Sheet

U.S. PATENT DOCUMENTS

| | | | | | |
|---|---|---|---|---|---|
| 4,595,353 | A | | 6/1986 | Haan | |
| 4,746,285 | A | * | 5/1988 | Guerra | 431/202 |
| 5,000,159 | A | * | 3/1991 | Clarke et al. | 126/91 A |
| 5,073,104 | A | * | 12/1991 | Kemlo | 431/12 |
| 5,083,004 | A | * | 1/1992 | Wells et al. | 219/121.5 |
| 5,110,287 | A | * | 5/1992 | MacPherson et al. | 432/24 |
| 5,199,867 | A | * | 4/1993 | Yap | 432/13 |
| 5,488,355 | A | * | 1/1996 | Tindall et al. | 340/578 |
| 5,632,614 | A | * | 5/1997 | Consadori et al. | 431/79 |
| 5,779,465 | A | | 7/1998 | Clarke et al. | |
| 6,142,765 | A | * | 11/2000 | Ramaseder et al. | 431/9 |
| 6,175,676 | B1 | * | 1/2001 | Sharan | 385/100 |
| 6,196,834 | B1 | * | 3/2001 | Berger | 431/266 |
| 6,311,475 | B1 | * | 11/2001 | Ngo-Beelman et al. | 60/39.827 |
| 6,345,979 | B1 | * | 2/2002 | Taylor et al. | 431/266 |

FOREIGN PATENT DOCUMENTS

| | | |
|---|---|---|
| JP | 6249429 | 9/1994 |
| JP | 2004/020050 | 1/2004 |

* cited by examiner

METHOD AND DEVICE FOR IGNITING AND MONITORING A BURNER

The present invention relates to a method and to a device for igniting and monitoring a burner.

The invention is mainly concerned with so called SER-type burners, i.e. burners that include in the extension of the burner head a pipe which is surrounded by an outer pipe that has a closed bottom but the invention can also be of the applied to "straight-through" burners or open burners that lack the provision of a protective pipe.

BACKGROUND OF THE INVENTION

A burner is typically monitored with the aid of an electrode placed at the periphery of the flame. The electrode is coupled to an electric circuit which is unable to conduct electric current until the circuit is connected between electrode and burner or flame pipe as a result of ionization at the flame periphery. Alternatively, there is used a UV-detector for detecting the ultra violet radiation that occurs in the presence of combustion.

Ionization detection requires the placement of an electrode in the edge of the flame, whereas UV-detection requires the ability to capture said UV-radiation.

A problem occurs with ionizing detection in the case of so-called high speed burners. In the case of high speed burners, a fuel mixture flows from the burner head at a high velocity, meaning that the length and the position of the flame will vary with the velocity of the outflowing fuel mixture. The position of the flame therefore requires an electrode whose length is greater than the electrode of a conventional burner and which hangs freely or, in the best of cases, can be supported with the aid of a ceramic outer pipe. There must be no metallic contact with the burner.

The problem is further accentuated by the desire to use a detection electrode to ignite the flame, by applying a high voltage through the electrode in order to generate a spark between its forward part and the burner upstream of the inrushing fuel/air mixture. The use of a high voltage means that the electrode must be enclosed by a ceramic pipe in order to isolate the electrode from the burner, meaning that the cross-sectional surface area of the electrode will be other than negligible in respect of the fuel-mixture delivery channel of the burner.

A typical ignition electrode that is dimensioned to ensure sufficient shape stability and oxidation length of life will, together with an insulating ceramic, reduce considerably the space available for conducting fuel and combustion air/premix air.

In addition to a high speed burner producing a variable flame form, the position of the electrode becomes more critical when power is increased. The best ionization is obtained at the edge of the flame. An electrode which is placed along the longitudinal axis of the burner will either function poorly or not at all.

Eccentric positioning of the electrode will result in disturbance of the flame symmetry.

It has been observed that in the case of UV-detection a UV-sensor viewing angle that deviates axially is highly sensitive to the position of the flame.

These problems are resolved by means of the present invention, the object of which is to provide a construction which is less pretentious with regard to the cross-sectional area of the burner than traditional present day solutions, while maintaining mechanical stability and oxidation life length.

SUMMARY OF THE INVENTION

The present invention thus relates to a method of igniting and monitoring a high speed burner with which a fuel/oxygen mixture flows from a burner head at high velocity, wherewith the length of the flame is dependent on said velocity, wherein the invention is characterized by placing an electrically conductive pipe in and concentrically with the burner channel intended for said fuel mixture wherein the first end of the pipe is terminated close to the fuel mixture outlet of the burner head, wherein the pipe is provided with an electrical insulation, and wherein light from the group ultraviolet light, visible light and/or infrared light is caused to be detected at the other end of the pipe, and wherein, in the case of ignition, a spark is caused to be generated between the first end of the pipe and the surrounding burner head through the medium of the electric voltage.

The invention also relates to a burner of the kind that has the significant characteristic features set forth in the accompanying claim 5.

DETAILED DESCRIPTION

Figure 1:
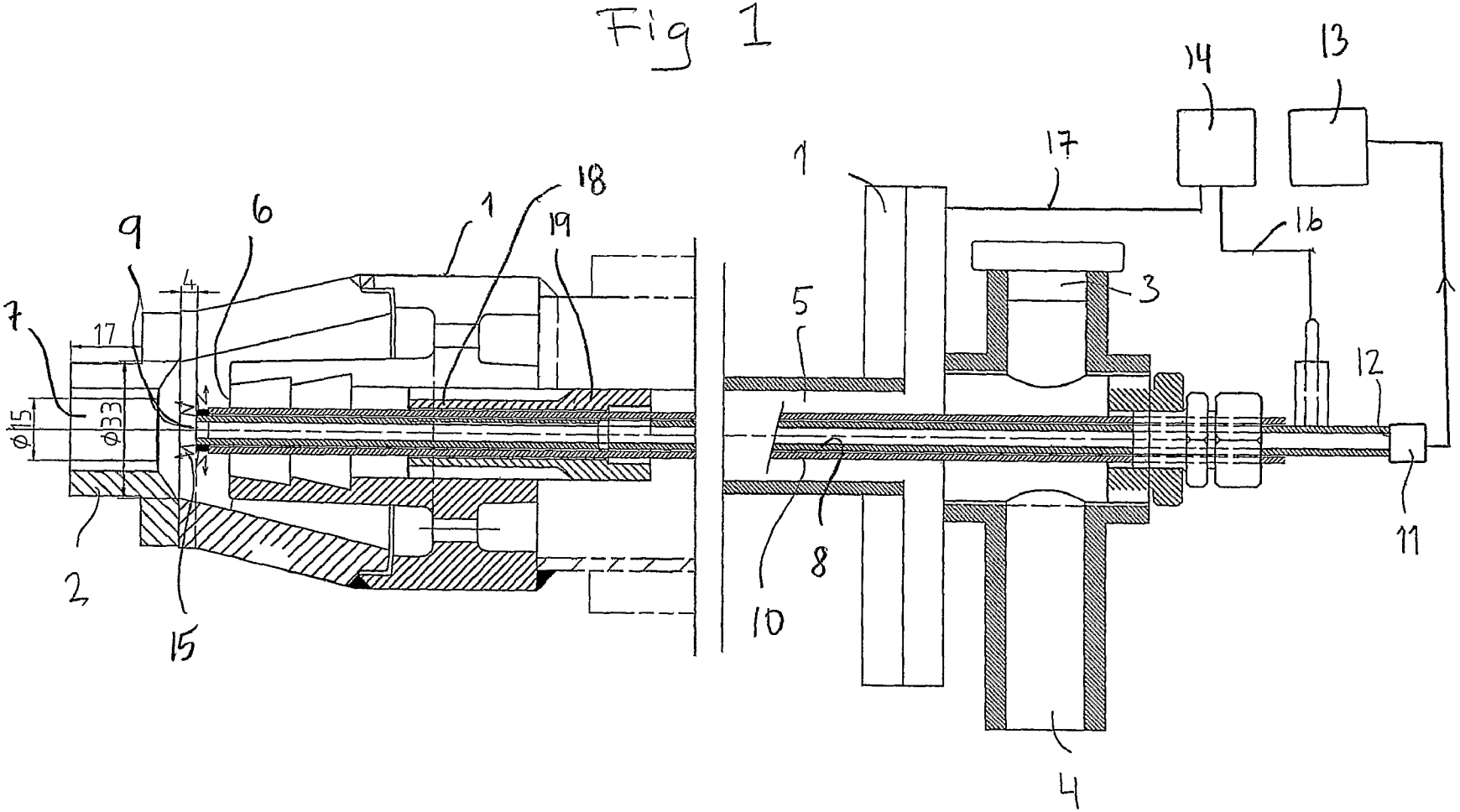
FIG. 1 is a longitudinal sectioned view of an inventive burner.

FIG. 1 illustrates a high speed burner with which a fuel/oxygen mixture is intended to exit at high velocity from a burner head 2, wherewith the length of the flame is dependent on said velocity. FIG. 1 shows only the front and the rear part of the burner. The rear part of the burner includes respective fuel and oxygen-containing gas inlets 3, 4. The mixture is transported in a tubular channel 5 whose orifice 6 is surrounded by the burner head 2. The burner head includes a mixture outlet 7 and the mixture is combusted externally of the burner head.

According to the invention, the burner includes an electrically conductive pipe 8 placed in and concentrically with the fuel mixture conveying channel 5 of the burner 1. The first end 9 of the pipe 8 terminates close to the fuel mixture outlet of the burner head.

Moreover, the pipe is provided with an electric insulation 10 which, according to a preferred embodiment of the invention is comprised of a ceramic pipe that encases the electrically conductive pipe.

According to the invention, a light detector 11 is placed at the other end 12 of the pipe 5, said detector being intended to detect light belonging to the group ultraviolet light, visible light and/or infrared light. The detector is designed to emit an electric signal dependent on the light detected, said signal being sent to a detection circuit 13 which is caused to detect whether or not combustion has taken place.

Furthermore a voltage source 14 is connected to said pipe 5 and to the burner 1 by means of electrical conductors 16, 17, so that in the case of ignition a spark 15 is generated between the first end 6 of the pipe and the surrounding burner head 2 through the medium of said voltage.

The present invention relates to a method of igniting and monitoring such a burner. According to this method, the pipe is placed in and concentrical with the burner channel for said fuel mixture, and the first end of the pipe is terminated close to the fuel-mixture exit orifice of the burner head. The pipe is insulated electrically. Light from the group ultraviolet light, visible light and/or infrared light is caused to be detected at the other end of the pipe so as to detect whether or not combustion occurs. Ignition is effected by causing a spark to be generated between the first end of the pipe and the surrounding burner, through the medium of an electric voltage.

This enables conditions to be achieved that result in sufficiently high UV-radiation from a burner flame to allow detection to be achieved with the aid of a typical UV-detector 11 in respect of an industrial burner, with the possibility of maintaining flux symmetry and minimum influence on the flow conditions.

In order to give the detection a function that is not dependent on burner power, the line of view extends in the central axis of the burner, in other words immediately downstream of the flame.

An eccentrically positioned viewing or sighting channel will be more dependent on the position of the flame in respect of capturing the light to the detector 11, irrespective of whether said channel is parallel with or at a small angle to the burner axis. Moreover, an eccentrically positioned sighting channel will result in asymmetry or disturbance in the flow pattern of the inflowing fuel mixture.

Furthermore, the pipe 8 constitutes a centrally positioned ignition electrode which, as a result of its tubular configuration, is able to permit a sufficiently large sighting or viewing channel, therewith fulfilling requirements with regard to both detection and ignition. It is also possible to lead some of the fuel mixture through the pipe 8. This increases the available cross-sectional area in the burner channel 5 for the fuel mixture. In such cases inlet openings are provided in the pipe 8 at the downstream part of the burner.

According to one preferred embodiment of the invention, at least one support leg 18 that includes radial wings 19 is placed in the fuel mixture channel and adapted to maintain said coaxial position of the pipe.

By constructing the pipe of a material that is electrical conductive in the temperature range of 50-2500 degrees C., it is possible to utilize the ratio of the moment of surface inertia to stiffness, this ratio being greater to that of a rod. This greater stiffness or rigidity enables the wall thickness to be reduced. As before-mentioned, the cylindrical cavity can be used for medium transportation and therewith provide more room for the passage of gas and air. This reduces the overpressure required to drive the combustion components as distinct from the case when the cavity is not used.

The coaxial positioning of the pipe 8 is of uttermost importance in respect of combustion technology, since it has been found that the positioning of the pipe has no detrimental effect on the combustion characteristics of the burner.

Tests have shown that a centrally positioned pipe 8 that has an internal cross-sectional area of about 19 $mm^2$ will capture sufficient UV-radiation. This pipe will capture more radiation than an eccentrically positioned pipe that has an internal cross-sectional area of 64 $mm^2$.

Although the invention has been described above with respect of an ultraviolet light detector, it will be understood that this detector can be replaced with a visible light detector or with an infrared light detector said lights being detected by a suitable known detector connected to said detection circuit.

Although the invention has been described above with reference to a number of exemplifying embodiments thereof, it will be understood that the described embodiments can be varied with respect to the choice of material used and their dimensions.

It will therefore be understood that the invention is not restricted to said embodiments but that variations and modifications can be made within the scope of the accompanying claims.

The invention claimed is:

1. A method of igniting and monitoring a high speed burner (1) including a burner head (2) from which a fuel/oxygen-mixture exits at high velocity, comprising the steps of:

providing an electrically conductive pipe (8) having a sighting channel inside and concentric with a burner channel (5) in communication with said burner head (2) such that a first end of the conductive pipe (8) terminates close to a fuel mixture outlet (7) of the burner head (2) wherein the burner head surrounds the burner channel;

electrically isolating the conductive pipe (8) with ceramic insulation;

supporting the conductive pipe (8) with support legs (18) placed in said burner channel (5) such as to maintain a coaxial position of the conductive pipe (8) in said channel;

flowing the fuel/oxygen mixture through the burner channel (5) such that the fuel/oxygen mixture exits the burner head (2) at a high exit velocity;

generating a spark (15) between the first end (9) of the conductive pipe (8) and the surrounding burner head (2) by application of a voltage to ignite the burner and begin combustion of the fuel/oxygen mixture outside the burner head (2), thereby forming a flame outside of the burner head, the length of the flame being governed by exit velocity; and detecting, at a second end (12) of the conductive pipe (8) opposite the first end of the conductive pipe (8), light radiated from the flame outside the burner head via the sighting channel.

2. The method according to claim 1, wherein the pipe is electrically isolated by mounting ceramic insulation (10) around the conductive pipe (8).

3. The method according to claim 1, wherein the detecting step further comprises the sub-step of:

emitting an electric signal to a detector circuit (13) for determining whether or not the combustion takes place.

4. The method according to claim 2, wherein the detecting step further comprises the sub-step of:

emitting an electric signal to a detector circuit (13) for determining whether or not the combustion takes place.

5. A high speed burner, comprising:

a burner head (2) comprising a fuel mixture outlet (7);

a housing connected to the burner head (2) forming a fuel mixture conducting channel (5) extending from the burner head (2);

an electrically conductive pipe (8) having a sighting channel ceramically insulated over an entire length of the conductive pipe arranged concentrically within the burner head and the fuel mixture conducting channel (5) extending from the burner head (2), a first end (9) of the conductive pipe (8) terminating in close proximity to the fuel mixture outlet (7) of the burner head (2), the burner head surrounding the fuel mixture conducting channel (5);

a light detector (11) provided at an opposite second end (12) of the conductive pipe (8), said light detector (11) configured to detect via the sighting channel at least one of ultraviolet light, visible light and infrared light radiated from a flame formed by a combustion outside the burner head (2);

a voltage source (14) connected to the conductive pipe (8) and to the burner head (2) such as to generate a spark (15) between the first end (9) of the conductive pipe (8) and a portion of the burner head (2) surrounding the conductive pipe (8) for igniting the burner (1); and at least one support leg (18) in the fuel mixture conducting channel (5) connected to said conductive pipe (8) and said burner head (2) and configured to maintain said conductive pipe (8) in a co-axial arrangement with the fuel mixture conducting channel (5).

6. The burner according to claim 5, wherein the pipe is electrically isolated by a ceramic insulation (10) around said pipe (8).

7. The burner according to claim 5, wherein the light detector (11) is configured to send an electric signal to a detector circuit (13) for detecting whether or not the combustion has taken place.

8. The burner according to claim 5, wherein the light detector (11) is configured to send an electric signal to a detector circuit (13) for detecting whether or not the combustion has taken place.

9. A high speed burner comprising:

an extended housing forming a cylindrical fuel mixing channel;

a burner head including a fuel mixture outlet at a first end portion of the fuel mixing channel;

an electrically conductive pipe having a sighting channel extending into the fuel mixing channel and running concentrically through an entire length of the fuel mixing channel, an aft end of the pipe at an opposite second end portion of the fuel mixing channel and a forward end of the pipe at a location just before the burner head at the first end portion of the fuel mixing channel, the burner head surrounding the electrically conductive pipe;

a ceramic electrical insulator substantially encasing a length of the electrically conductive pipe from the second end portion of the fuel mixing channel to a location just before the forward end of the electrically conductive pipe;

a voltage source connected to the electrically conductive pipe and configured to create a spark and a light detector to detect, via the sighting channel, a light created by a flame resulting from combustion external to the burner head.

10. The high speed burner according to claim 9, further comprising at least one support leg in contact with the electrical insulator and the fuel mixture conducting channel to maintain the electrically conductive pipe in a concentric orientation through an entire length of the fuel mixing channel.

11. The high speed burner according to claim 9, wherein the light detector is selected from the group consisting of a UV light detector, an infrared light detector and a visible light detector.

12. The high speed burner according to claim 9, wherein the electrically conductive pipe extends beyond the electrical insulator and the fuel mixture conducting channel to form an exposed conductive portion of the electrically conductive pipe.

13. The high speed burner according to claim 12, wherein the spark is generated between the conductive portion of the electrically conductive pipe and a portion of the burner head.

14. The method according to claim 2, wherein the pipe is electrically isolated by mounting ceramic insulation (10) around a length of the conductive pipe (8) extending from a first location just before the first end of the conductive pipe (8) to a second location where the conductive pipe (8) enters the burner channel (5).

15. The method according to claim 1, wherein the light detected in the detecting step is one of ultraviolet light, visible light and infrared light.

16. The burner according to claim 5, further comprising:

a ceramic insulation (10) encasing a length of the conductive pipe (8) extending from a first location just before the first end of the conductive pipe (8) to a second location where the conductive pipe (8) enters the burner channel (5).

17. The burner according to claim 5, wherein the at least one support leg (18) includes a radial wing (19) extending away from a surface of the conductive pipe (8) to the housing of the fuel mixture conducting channel (5).

18. The burner according to claim 17, wherein a plurality of the support legs (18) secure the conductive pipe (8) to be concentric and co-axial with the fuel mixture conducting channel (5).

19. The high speed burner according to claim 9, wherein the light detector is configured such that the light from the combustion external to the burner head is detected at the aft end of the pipe.

* * * * *